US007341025B1

(12) United States Patent
Streeter et al.

(10) Patent No.: US 7,341,025 B1
(45) Date of Patent: Mar. 11, 2008

(54) GAIT TRAINING HARNESS

(75) Inventors: Jeffery Streeter, Boise, ID (US); Julie Streeter, Boise, ID (US)

(73) Assignee: Lucky Bums, Inc., Boise, ID (US)

( * ) Notice: Subject to any disclaimer, the term of this patent is extended or adjusted under 35 U.S.C. 154(b) by 140 days.

(21) Appl. No.: 11/278,951

(22) Filed: Apr. 6, 2006

(51) Int. Cl.
*A62B 35/00* (2006.01)

(52) U.S. Cl. ..... 119/857; 119/770; 182/3; 482/69

(58) Field of Classification Search ..... 119/857, 119/856, 907, 769, 770, 771; 54/71; 128/875; D29/101.1; 182/3, 6; 224/160; 482/69, 482/43

See application file for complete search history.

(56) References Cited

U.S. PATENT DOCUMENTS 3,424,134 A * 1/1969 Rosenblum ..... 182/3
4,922,860 A 5/1990 Hutchings
5,388,551 A * 2/1995 Martusciello ..... 119/770
5,435,272 A 7/1995 Epstein
5,487,444 A * 1/1996 Dennington ..... 182/6
6,325,023 B1 12/2001 Elnatan
6,338,699 B1 1/2002 Veitch
6,361,478 B1 3/2002 Giancaspro
6,397,389 B1 6/2002 Schultz
6,836,902 B2 1/2005 Marquez et al.
6,942,630 B2 * 9/2005 Behan ..... 602/19

* cited by examiner

*Primary Examiner*—T. Nguyen
(74) *Attorney, Agent, or Firm*—Your Intellectual Property Matters, LLC; Robert A. Frohwerk

(57) ABSTRACT

A full body Gait Training Harness for children with disability may be modified for adult use to assist a trainer to teach functions such as walking with a proper gait and crawling. Shoulder straps attached to a torso-encircling belt cross at the trainee's back to eliminate slippage, allowing use on those who have no arms. Leg loops secure the harness to the thighs, rather than through the crotch, for a more secure and comfortable fit. Leg stabilization straps between the leg loops and the shoulders provide tension to encourage development of a proper gait and to prevent crossing of the trainee's legs. Shoulder handles allow a trainer to support a trainee from above without stooping, while a back handle may be used to lift a trainee or support them in a crawling position. Walking extension straps attached to the shoulders allow trainee independence while the trainer retains control.

8 Claims, 4 Drawing Sheets

GAIT TRAINING HARNESS

CROSS-REFERENCES TO RELATED APPLICATIONS

Not Applicable.

STATEMENT REGARDING FEDERALLY SPONSORED RESEARCH OR DEVELOPMENT

Not Applicable.

FIELD OF THE INVENTION

The present invention relates generally to a harness for supporting a child or disabled person from above to assist foot travel. More particularly, the described device provides a means of training to assist learning or readapting to the motor coordination skills required for walking.

BACKGROUND OF THE INVENTION

Physical and Occupational Therapists as well as families with a disabled child desire a simple device that can be used to assist them in training those in their care to crawl and to walk. In the past trainers have mainly used their hands to hold the trainee around the waist or torso, but this involves bending over or stooping which places the trainer in a weakened position and prone to injury. Some trainers use various types of infant walkers, which may reduce the load they need to support but provides little other assistance. Many harnesses have been devised by others not only for such therapeutic purposes but also for teaching such recreational abilities as skiing and skating. Full Body Harnesses exist in the marketplace for various purposes such as rock climbing and hang gliding, but these are not well suited to the immediate requirements discussed here.

The support harness for a young child described by Epstein in U.S. Pat. No. 5,435,272 shows a combination of shoulder and leg straps held in place by a belt. To this harness is attached an overhead loop to which two separate leashes are attached in turn. This provision for two handholds might have been suitable for the current application had the two not been removed some distance from the shoulders by their attachment to the single loop between the shoulders. This additional layer of connections removes control of the trainee from the trainer.

In his U.S. Pat. No. 6,338,699 Veitch describes a child sport activity-training device comprising a harness that enables support of a torso of a child with a handgrip grasped by the hand of a trainer. The design of Veitch uses a single overhead loop attached to shoulder straps to serve both for support and guidance or control. In the context of the present discussion, in comparison to Epstein, it appears that Veitch has simply removed the two leashes so that a trainer is placed closer to the trainee. This sacrifices control at some distance in favor of better support. While the device of Veitch may be suitable for support of a relatively able-bodied child, it affords very little control to the trainer.

In order to achieve more reliable support and better control for more challenging trainees, it is necessary to separate these functions. Handholds closer to the shoulder will provide more reliable support. Better control can be achieved by separating the single leash loop of Veitch to provide the trainer with two independent leashes that, when attached directly to the shoulder straps, may be used for more subtle directional guidance as well as for tighter control. The addition of a handle at the back nearer the waist and closer to the center of gravity of the trainee will provide both much greater control and support in some working situations, especially when the trainee is crawling or attempting to stand from a prone or sitting position.

BRIEF SUMMARY OF THE INVENTION

The disclosed invention relates to a device that enables a trainer to assist a child or physically-challenged person to learn to stand, to crawl, and to walk with a suitable gait. The device is based upon a full body harness that is worn by the trainee. Components of the described harness and attachments have been designed to provide the trainer with optimal control in order to safely assist the trainee.

The harness begins with a torso-encircling belt to which shoulder and leg straps are attached. The two ends of each of two shoulder straps are attached to the torso-encircling belt in such a manner that these straps cross one another at the back of the trainee below the neck, the straps being attached to one another at the crossover point. This crossover design prevents the straps from sliding off of the shoulders and is especially useful for securing trainees who have no arms. Each shoulder strap is fitted with a handle to enable the trainer to assist the trainee to rise to a standing position or to support them. Connections are provided for attachment of a leash-like device, referred to here as a Walking Extension Strap, to each of the shoulder straps so that the trainee may walk independently without interaction from the trainer while allowing the trainer to use the straps to prevent the trainee from falling or to provide some guidance when necessary. Depending upon adjustments made to the shoulder straps and leg straps, the torso-encircling belt may be located anywhere along the torso below the armpits and above the hips of the person wearing it.

Each of the two ends of two leg straps also attach to the foundational torso belt. Each strap forms a loop that encircles a leg. Connection of each leg strap to both the front and the rear of the torso belt provides for significant control by the trainer. Appropriately positioned connectors allow for the addition of Leg Stabilization Straps between the shoulder straps and the leg-encircling loops. This attachment may be made from the front of the shoulder to allow the trainer to assist in the advancement of the trainee's legs during gait training. Alternately, when connected at the rear of the shoulder the Leg Stabilization Straps prevent the trainee's legs from crossing over one another as the legs are extended during walking.

All strap segments are adjustable to accommodate trainees of different sizes as well as changes in individuals due to weight gain or loss, or thickness of underlying clothing. Connections between the various elements of the gait training harness are restricted where needed for optimal control but are adjustable or relocateable where such control is not necessary or where it is desired to give the trainee greater freedom of motion. The harness which incorporates many features that allow the trainer to stand behind or over the trainee and to be involved during walking or crawling activities without causing undue strain to the trainer or discomfort to the trainee. Additional aspects and advantages of this invention will be apparent from the following detailed description of preferred embodiments, which proceeds with reference to the accompanying drawings.

BRIEF DESCRIPTION OF THE DRAWINGS

The particular features and advantages of the invention briefly described above as well as other objects will become apparent from the following description taken in connection with the accompanying drawings, in which.

Figure 1:
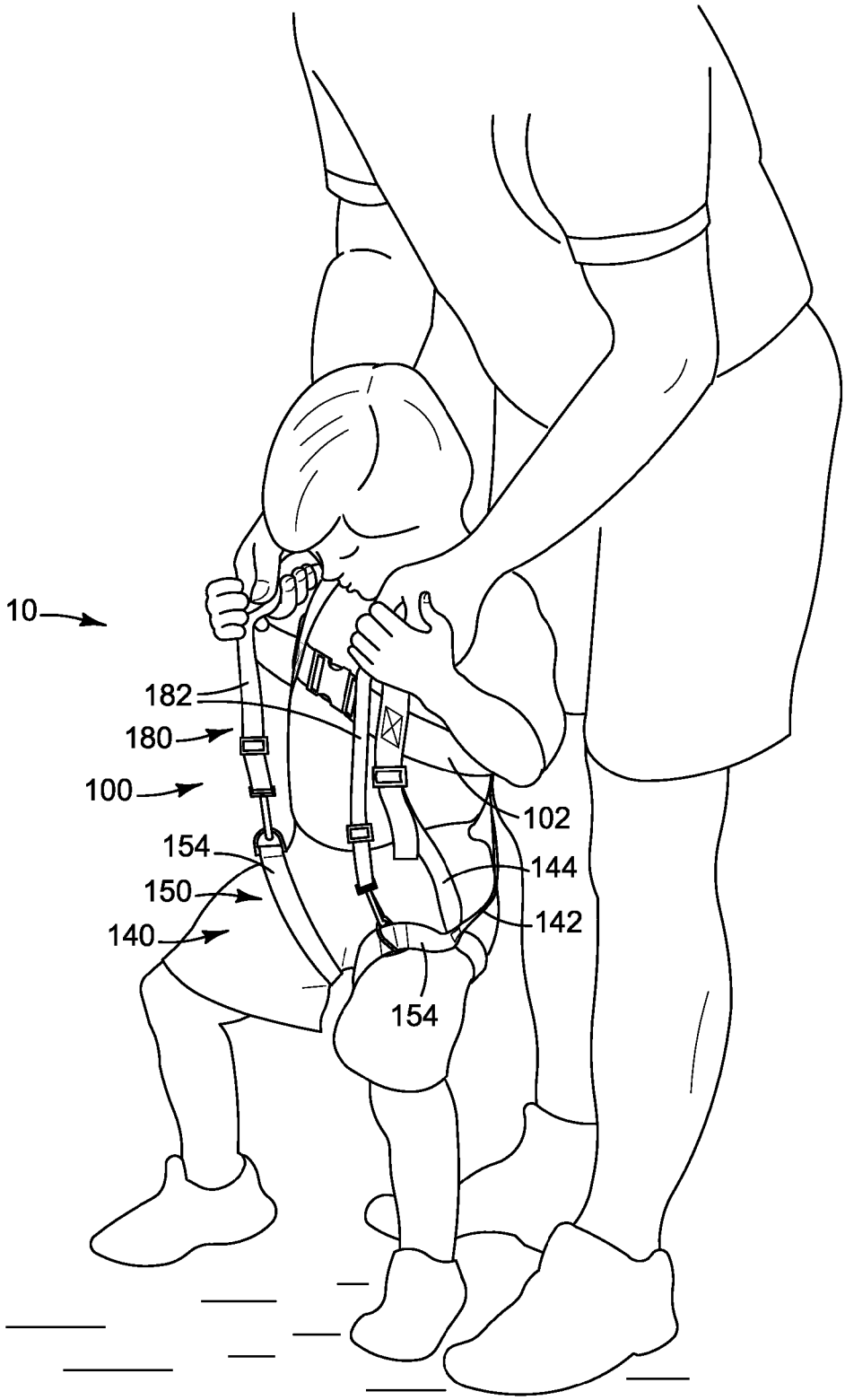
FIG. 1 depicts the gait training harness in one mode of use wherein an adult trainer is assisting a child who is learning to walk.

The following Reference Numbers may be used in conjunction with one or more of the accompanying FIGS. 1-4 of the drawings:

10. Gaiter Harness
100. Full Body Harness (FBH) with lifting support through leg straps
102. torso-encircling belt
104. torso belt buckle
106. strap attachment to torso belt, front
108. strap attachment to torso belt, rear
120. shoulder strap assembly
122. shoulder strap
124. shoulder handle locator
126. shoulder strap adjustable connector, front
128. shoulder strap adjustable connector, rear
130. Back Handle (BH) assembly
132. back handle
134. back handle locator
140. leg strap assembly
142. leg strap, rear portion
144. leg strap, front portion
146. leg strap adjustable connector, front
148. leg strap adjustable connector, rear
150. Leg Loop (LL) assembly
152. leg loop, inner portion
154. leg loop, outer portion
156. leg loop, crossover
158. leg loop attachment locator
160. Crossover Shoulder Strap (CSS)
162. Shoulder Handle (SH)
164. shoulder attachment connector
166. leg loop attachment connector
180. Leg Stabilization Strap (LSS) assembly
182. leg stabilization strap
184. leg stabilization strap adjustment
186. leg stabilization strap connector, lower
188. leg stabilization strap connector, upper
190. Walking Extension Strap (WES) assembly
192. walking extension strap
194. walking extension strap connector
196. walking extension strap handle

DETAILED DESCRIPTION OF THE INVENTION

The present invention is primarily a training device to assist a trainer to teach a child to walk or crawl, or to support and assist a disabled person to develop the motor coordination skills required for walking with a proper gait. FIG. 1 depicts the presently invented gait training harness in one exemplary use. Here, an adult trainer is seen to be standing over a child trainee without stooping significantly. This trainer is using shoulder handles to support the child who is learning to walk. Other modes of use will now be described with reference to FIGS. 2 through 4 in which the trainer and trainee have been removed in order to show more clearly the features of the harness itself.

Figure 2:
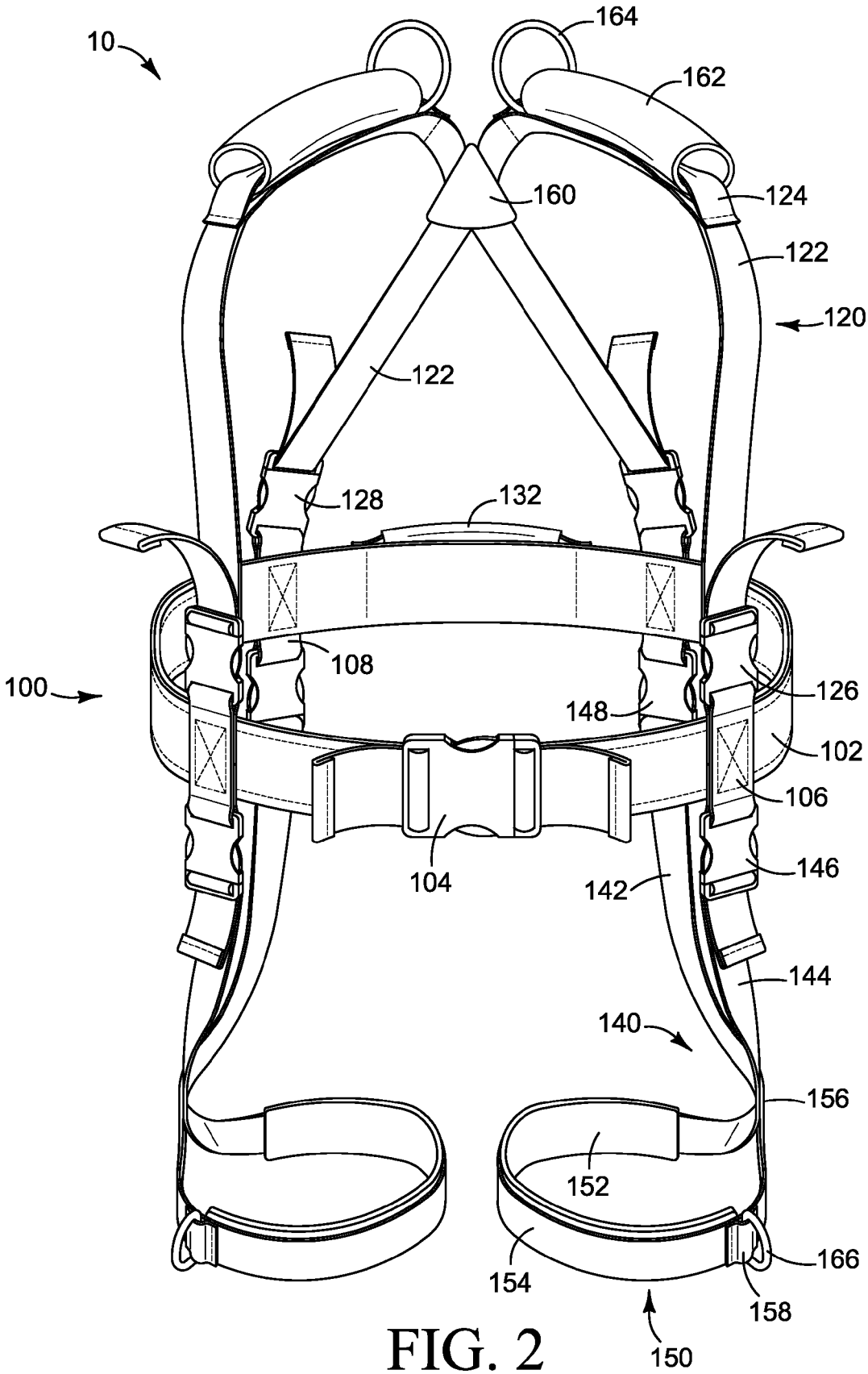
FIG. 2 shows a frontal view of the gait training harness.

The foundation of the device, as shown in the frontal view of FIG. 2, is a Full Body Harness (FBH) 100 which begins with a torso-encircling belt 102 that is secured around the torso of the trainee by a torso belt buckle 104. The Full Body Harness 100 is completed by the addition of two shoulder strap assemblies 120 and two leg strap assemblies 140. In the preferred embodiment, all straps are constructed from webbing material as is commonly used for sports accessories and outdoor equipment. Since these pairs of shoulder and leg strap assemblies (120, 140) bear left-right symmetry each to the other, their components are identified in the figures only for the left side of the harness, as seen by the trainee who would be wearing it. The torso-encircling belt 102 is fitted with four strap attachments, 106 and 108, to accommodate left and right for both front and rear. These strap attachments (106, 108) become the points of attachment for the shoulder 120 and leg strap assemblies 140, to complete the basic Full Body Harness 100.

In order to accommodate trainees of various sizes, each of the shoulder strap assemblies 120 and leg strap assemblies 140 are fitted with adjustable connectors at each end of each strap. Each shoulder strap assembly 120 comprises a shoulder strap 122 which terminates at the front of the torso-encircling belt 102 in an adjustable shoulder strap connector 126, and in another adjustable shoulder strap connector 128 at the rear. In the preferred embodiment, as shown, strap connectors 126 and 128 are two-part side release buckles of the variety now commonly used for outdoor equipment such as backpacks. These connectors comprise both male and female parts, one of which (say, the female part) is held captive in a fixed location in the upper portion of strap attachments 106 and 108. The other (male) portion of the strap connectors 126 and 128 attaches respectively to the front and rear ends of the shoulder strap 122 so as to allow for the adjustment of the length of each end of the shoulder strap 122 with the length of the front segment of the strap being adjustable independently of the length of the rear segment of the strap 122.

The leg strap assemblies 140 are suspended from the torso-encircling belt 102 using a connector system similar to that employed for the shoulder strap assemblies 120. The female portion (for instance) of an adjustable leg strap connector 148 is captured in the lower portion of strap attachments 108. The mating portion of leg strap connector 148 is adjustably attached at the upper end of the rear portion of leg strap 142. Similarly, one part of the adjustable leg strap connector 146 is captured in the lower portion of strap attachment 106 with the second part of the adjustable leg strap connector 146 adjustably attached at the upper end of the front portion of leg strap 144.

The lower portions of rear and front leg straps 142 and 144 are bound to each other at a leg strap crossover 156 beyond which they extend to form the Leg Loop (LL) assembly 150. Below the crossover 156, extensions of leg straps 142 and 144 become inner and outer portions, 152 and 154, of the leg loops. In the preferred embodiment the inner portion of the leg loop 152 is overlaid by the outer portion of the leg loop 154 and the two are connected by means of a hook and loop fastener that has been affixed to the surfaces between them. Although other connector systems may be used, the hook and loop produces a leg loop that lies flat and is comfortable to the trainee.

After the gait training harness has been attached to the torso of the trainee, the leg straps, 142 and 144, are pulled down comfortably so that the leg strap crossover 156 is positioned below the hip at the outer thigh of the trainee. The inner portion of the leg loop 152, extending from the rear leg strap 142, is wrapped around the front of the thigh towards the inside after which the outer portion of the leg loop 154, coming from behind is wrapped over the inner leg loop 152 so as to complete the connection forming a snug fit around the leg. Shown in its preferred embodiment, the leg loops may be quickly disconnected and fully removed, though other embodiments may be envisioned that do not offer this feature.

Connecting the gait training harness to the trainee's legs in the manner of the preferred embodiment has multiple advantages over other approaches. Other harnesses most often support the body of the wearer through the crotch; using either straps or panels of material that are wrapped from the front of the body between the legs to the back of the body. One advantage of the present invention is that the Full Body Harness with Leg Loops supports the body of the trainee by the legs (thighs) which distributes the trainee's weight more evenly over a greater area so as to reduce any concentrated pressure, especially at the groin. A second advantage is that the leg loops 150 may be used to afford an additional level of control to the trainer.

The torso-encircling belt 102 with two shoulder strap assemblies 120 and two leg strap assemblies 140, each of which assemblies is fully adjustable, complete the Full Body Harness 100. With straps of sufficient length and weight carrying capacity, a single harness could be made to accommodate any individual. However, it is preferred to provide at least two differently sized harnesses, one for a child and the second for an adult. Beyond this, multiple sizes of the Full Body Harness 100 may be provided. In the extreme, a harness may be made to custom fit an individual, in which case one or more pairs of adjustable connectors may be deleted, those at the rear, 128 and 148, being the most likely initial candidates for removal. As described, the Full Body Harness 100 is certainly usable in many applications in addition to the present invention. For the immediate purpose, the Full Body Harness 100 as described provides a foundation having the necessary support structure to enable the proper function of all of the components that will distinguish the harness of the present invention from other similarly intended devices.

The Shoulder Handle (SH) 162 allows the trainer to stand over the trainee and provides a great level of control during walking or crawling activities. These simple handles allow a trainer to control the trainee without direct contact to their body. The trainer can work with the trainee without having to constantly bend over, therefore providing relief from strain to the trainer. While shoulder handle 162 is shown as a length of semi-rigid tubular material, other formats and materials may be accommodated within the intent of the present invention. The shoulder handle 162 is held in place near the top of shoulder strap 122 by the addition of a shoulder strap locator 124. In the preferred embodiment the shoulder strap locator 124 is simply a second strap of material similar to that of the shoulder strap 122 which has been stitched at its two ends to the underlying shoulder strap 122 so as to capture the shoulder handle 162 and to keep it from slipping along the length of that strap.

An important feature of the present invention is the Crossover Shoulder Strap (CSS). Rather than merely draping shoulder straps straight over a shoulder with both front and rear connections being made to the corresponding left or right side of the torso-encircling belt 102, the shoulder strap assemblies 120 here cross over one another at the trainee's back intersecting at shoulder strap crossover 160 where they are fixedly attached to one another. This design prevents the shoulder straps 122 from sliding off of the shoulders of the trainee, which is an especially important consideration for those trainees who have no arms. This seemingly simple feature is critical to the proper and stable positioning of the Full Body Harness 100 straps, and has been overlooked in the designs of others.

With the Crossover Shoulder Straps stabilized at the crossover 160, the four independently adjustable shoulder strap connectors 126 and 128 provide for proper placement of the left and right shoulder handles 162 without regard to the posture of the trainee, whether upright or stooped, or leaning to the left or right. When properly aligned the shoulder handles 162 allow a trainer to assert firm control over the upper body of the trainee without any need to grasp the trainee around the waist or torso as has been required by previous devices and methods related to them.

The Back Handle (BH) 132 is very similar in construction to the Shoulder Handle 162. The back handle assembly 130 is attached to the rear of the torso-encircling belt 102 and comprises a back handle locator 134 that is attached to the torso-encircling belt 102 so as to capture a back handle 132, preventing it from slipping around the torso-encircling belt 102. The back handle 132 may be constructed from any material similar to that described above for the shoulder handle 162, which in the preferred embodiment of the present invention is a length of semi-rigid tubing. Similarly, the back handle locator 134 is a length of webbing material that has been connected to the torso-encircling belt 102 near the ends of the back handle 132 so as to limit its longitudinal play around the torso of the trainee. The back handle 132 provides the trainer with a single point of control over the trainee when the latter is in a crawling position. In conjunction with the shoulder handles 162, the back handle 132 may be used by the trainer to assist the trainee to rise from a prone or seated position to an upright or standing position and to support them in that position. Like the Shoulder Handle 162, having the Back Handle 132 coupled relatively tightly to the underlying Full Body Harness 100 provides the trainer with a great deal of supportive control over the trainee without any need for hand to body contact of the torso or around the waist.

Additional features are incorporated into the gait training harness by means of accessory clips. At the same time that the shoulder handle 162 is installed within shoulder handle locator 124, a shoulder attachment connector 164 is included. In the preferred embodiment, the shoulder attachment connector 164 is a metal ring that is large enough to be able to slide over the shoulder handle 162 so that it may be used either at the front or rear ends of the region bound by the shoulder handle locator 124.

Similarly, leg loop attachment locators 158 are applied to the outer portions of leg loops 154 to capture leg loop attachment connectors 166. The preferred embodiment uses D-rings for the leg loop attachment connectors 166, and a web or strap material compatible with, and stitched to, the outer portions of leg loops 154 for the leg loop attachment locators 158.

Figure 3:
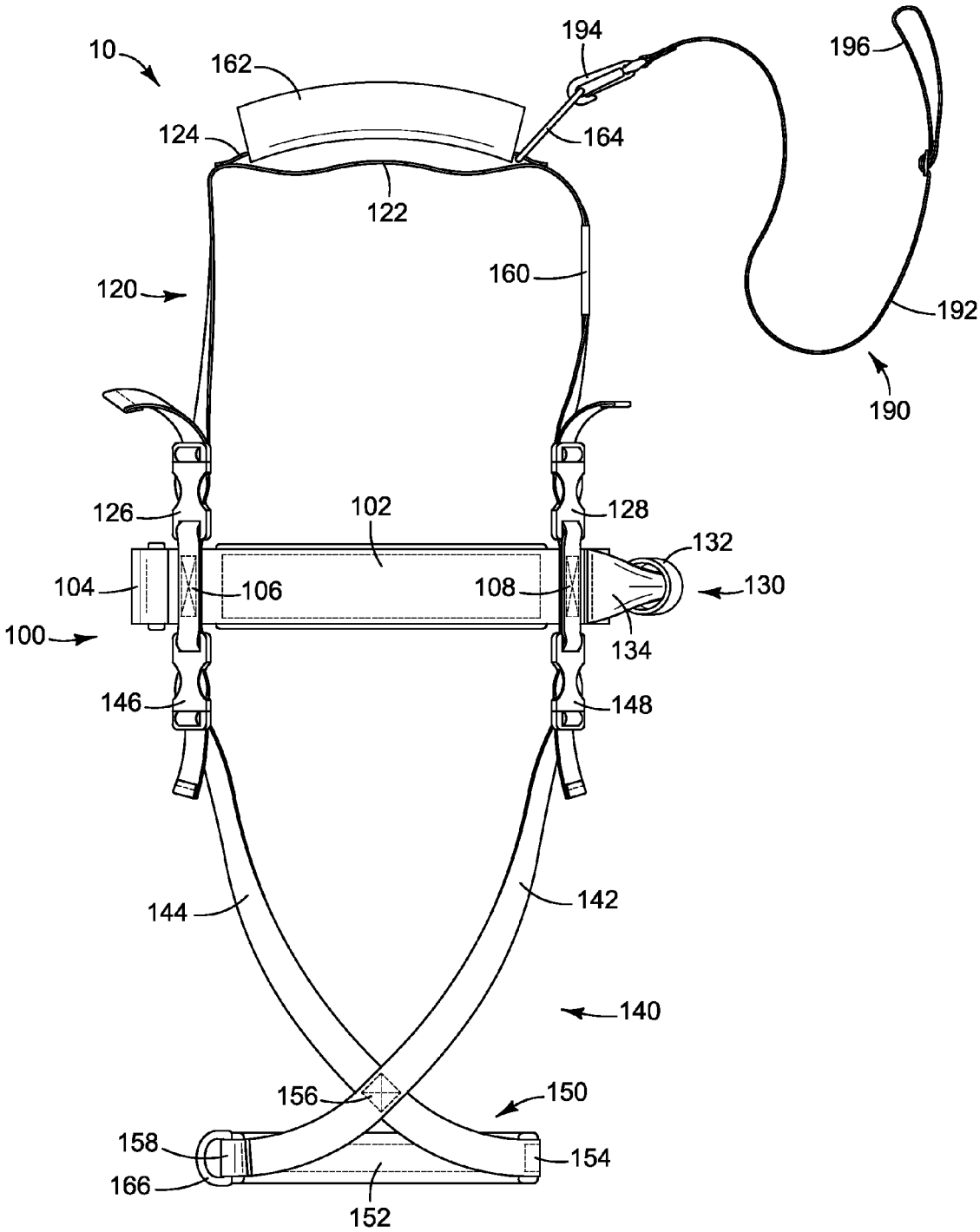
FIG. 3 is a left side view of the gait training harness with an attached Walking Extension Strap.

Referring now to FIG. 3, a Walking Extension Strap (WES) assembly 190 can be seen as it is attached for use.

The walking extension strap assembly 190 comprises the walking extension strap 192 proper with a walking extension strap handle 196 at one end, and a walking extension strap connector 194 at the other end. With the shoulder attachment connector 164 at the rear of the shoulder handle 162 and its motion restricted by the shoulder handle locator 124, the walking extension strap connector 194 is attached to the shoulder attachment connector 164 when the walking extension strap assembly 190 is to be used. The walking extension strap enables the trainee to walk independently, without handling or interaction from the trainer. With a walking extension strap assembly 190 attached to each (left and right) shoulder, the trainer is able, when needed, to use the straps for safety and to provide stability, preventing the trainee from falling. By separately controlling the straps attached to the trainee's left and right shoulders, the trainer is able to provide the trainee with some directional guidance, but only when necessary.

Due to the manner in which the Walking Extension Strap assembly 190 is attached to the Full Body Harness 100 both the trainer and the trainee are afforded considerable versatility of motion. Harnesses developed by others may have straps intended for a similar purpose but which lack the simultaneous versatility and effectiveness of the Walking Extension Strap 190 of the present invention. For example, the comparable straps shown in U.S. Pat. No. 5,435,272 issued to Epstein may be attached to various points, all of which lie on an overhead loop, too far removed from the trainee's body to be useful for the purpose of the present invention.

By attaching the Walking Extension Strap assembly 190 of the presently described gait training harness to the shoulder attachment connector 164 the strap can be positioned in the front or back, or even in the middle, of the Shoulder Handle 162 to provide maximum flexibility. For proper control, it is critical that the Walking Extension Strap assembly 190 be attached directly to the Full Body Harness 100 in a manner such as described. This tightly coupled attachment provides the trainer with a versatility of positioning the trainee that would not be possible with a looser, more remote coupling.

Figure 4:
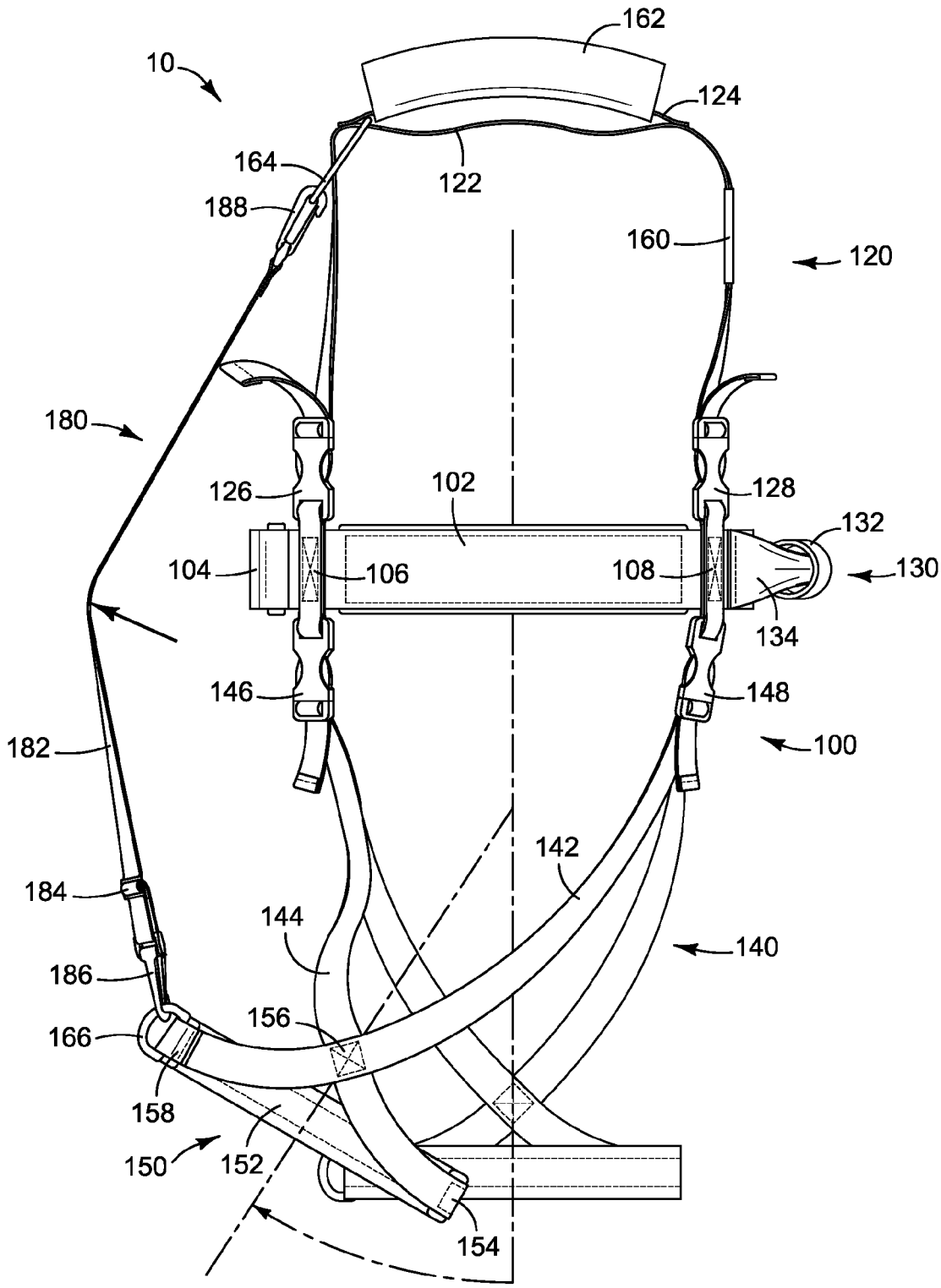
FIG. 4 shows a left side view of the gait training harness in an alternate mode wherein an attached Leg Stabilization Strap has been used to pull the left Leg Loop forward of the right one.

An alternate use of the shoulder attachment connector 164 is for the attachment of a Leg Stabilization Strap (LSS) assembly 180 as depicted in FIG. 4. The Leg Stabilization Strap assembly 180 comprises leg stabilization strap 182, which is terminated on its upper end with a leg stabilization strap connector 188 much like the Walking Extension Strap assembly 190. On its lower end, however, the Leg Stabilization Strap assembly 180 is attached through a leg stabilization strap adjustment 184 to a lower leg stabilization strap connector 186.

For a first mode of operation, as shown in FIG. 4, the shoulder attachment connector 164 is slipped to the front of the region bound by the shoulder handle locator 124 in front of the shoulder handle 162. The upper leg stabilization strap connector 188, shown as a spring hook, is then attached to the shoulder attachment connector 164. The lower leg stabilization strap connector 186 (also shown as a spring hook) is then connected to the leg loop attachment connector 166 and the leg stabilization strap adjustment 184, implemented here as a slide buckle, is used to adjust the length of the leg stabilization strap 182. When used in this frontal position, the trainer is able to assist in the advancement of the trainee's legs during gait training. With a slight upward pull on the leg stabilization strap 182 the trainer is able to apply pressure on the leg loop which pulls the leg up to start the gait. Also, Physical Therapists theorize that when pressure is sensed on the leg, that pressure acts as a trigger to the trainee to start the gait by picking up that leg. When the leg stabilization strap 182 is used in this interactive mode, the trainer needs to pull on one LSS 182 and then release it, then pull on the other LSS 182 and then release it, alternating the sequence, effectively pulling each LSS 182 to initiate each step.

In a second mode of operation the shoulder attachment connector 164 is slipped back to the rear of the shoulder handle locator 124 behind the shoulder handle 162, as when used with the Walking Extension Strap assembly 190. Otherwise, the ends of the Leg Stabilization Strap (LSS) assembly 180 remain connected as for the first mode of operation described above. The leg stabilization strap adjustments 184 are used to adjust the length of the straps 182 to apply tension to them. Using the LSS 182 in this rear position prevents the trainee's legs from crossing over one another as the legs are alternately extended during walking exercises. It will be recognized that there is no restriction to prevent the LSS 182 from being used in this mode while the trainee is walking freely but lightly tethered to the trainer by the Walking Extension Strap assemblies 190.

As shown here for the preferred embodiment, the straps within the full body harness 100 as well as those used for the leg stabilization straps 182 and walking extension straps 192 are made from various widths and configurations of web material. It will be recognized by one familiar with such materials that these components may be made from other materials such as, but not limited to, leather or cords, though flat material is preferred for the full body harness 100 proper in order to distribute pressure over larger areas to avoid gouging or chafing.

The type of connector shown for purposes of illustration of the preferred embodiment is a plastic side release buckle that is commonly used for outdoor clothing, camping gear and related accessories. Those familiar with such articles will recognize that other two-part separable connectors may be substituted without altering the functionality of the described invention. Furthermore, the unique features of the present invention could well be implemented with such age-old materials as leather belts and non-separable brass buckles, for instance.

The present invention has been described for use primarily as an aid for parents and physical therapists to assist children and disabled persons to develop the necessary motor skills related to crawling and to walking with a suitable gait. There is no intent here to preclude other uses of the described invention. Persons involved in training related to sports as well as other persons with an interest in recreational and physical activities will recognize a variety of other applications not specifically described here.

While the present invention has been described with respect to a preferred embodiment, there is no implication to restrict the present invention to preclude other implementations that will be apparent to those skilled in the related arts. It is easily recognized that the described invention may be implemented with a variety of components and alternate materials, therefore, it is not intended that the invention be limited to the disclosed embodiments or to the specifically described details insofar as variations can be made within the spirit and scope of the appended claims.

What is claimed is:

1. A gait training harness comprising:

an adjustable torso-encircling belt to fit a wearer;

two adjustable shoulder straps with shoulder handles; and two adjustable leg harnesses, one each for a left leg and a right leg, and each having a leg-encircling loop, wherein the torso-encircling belt comprises:

a belt material;

an adjustable coupler; and four attachment points spaced along the length of the torso-encircling belt, and wherein the shoulder straps comprise:

a left shoulder strap attached at a first end to an attachment point located at the front-left of the torso-encircling belt when worn by the wearer, and the left shoulder strap attached at a second end to a right-rear attachment point, and having an adjustable element at or near the first end of the left shoulder strap;

a right shoulder strap attached at a first end to an attachment point located at the front-right of the torso-encircling belt, and attached at a second end to a left-rear attachment point, and having an adjustable element at or near the first end of the right shoulder strap;

a crossover point at which the right shoulder strap crosses and is fixedly attached to the left shoulder strap at the back of the wearer below the neck, and a left shoulder handle and a right shoulder handle attached respectively to the left and right shoulder straps, each shoulder handle being offset from the shoulder strap and constrained along a length of the shoulder strap that would be above the shoulder of the wearer when the wearer is in an upright position;

and wherein the two leg harnesses each comprise:

a front leg strap attached at a proximal end to the front-left or front-right attachment point nearest the left or right leg that is to be harnessed, each front leg strap having an adjustable element at or near the proximal end;

a rear leg strap attached at a proximal end to the rear-left or rear-right attachment point nearest the corresponding left or right leg;

a leg-encircling loop attached to the distal ends of the front leg strap and the rear leg strap; and wherein the distal end of each front leg strap is affixed to the distal end of the corresponding rear leg strap at a leg strap crossover, and below said leg strap crossover wherein extensions of the distal ends of the front and of the rear leg straps are terminated with complementary portions of a connector, and wherein the leg-encircling loops are formed by laying the extension of the rear leg strap around the leg in one direction and bringing the extension of the front leg strap leg around the leg from an opposite direction and connecting the complementary portions of the connector.

2. The gait training harness of claim 1, further comprising:

a back handle attached to the rear of, and offset from, the torso-encircling belt, the back handle being constrained along a length of the torso-encircling belt near the center of the back of the wearer.

3. The gait training harness of claim 1, further comprising a shoulder accessory connector attached to each of the shoulder straps and constrained along the same length of the shoulder strap as the shoulder handle.

4. The gait training harness of claim 3, further comprising a walking extension strap attached to each of the left and right shoulder accessory connectors.

5. The gait training harness of claim 3, further comprising a leg accessory connector attached to each of the left and right leg-encircling loops and constrained to lie between the front and outer thigh when in use.

6. The gait training harness of claim 5, further comprising left and right leg stabilizing straps, wherein each leg stabilizing strap is connected between the shoulder accessory connector and the leg accessory connector on the corresponding left or right side.

7. The gait training harness of claim 1, further comprising one or more additional adjustable elements at or near one or more of the second ends of the left and right shoulder straps and/or the proximal ends of the left and right rear leg straps.

8. The gait training harness of claim 1, wherein the complementary portions of the connector comprise a hook and loop fastener.

* * * * *